US010106291B2

(12) United States Patent
Kearns

(10) Patent No.: US 10,106,291 B2
(45) Date of Patent: Oct. 23, 2018

(54) CARTON WITH DIVIDER

(71) Applicant: Graphic Packaging International, Inc., Atlanta, GA (US)

(72) Inventor: Matthew R. Kearns, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 184 days.

(21) Appl. No.: 15/177,653

(22) Filed: Jun. 9, 2016

(65) Prior Publication Data

US 2016/0362220 A1 Dec. 15, 2016

Related U.S. Application Data

(60) Provisional application No. 62/230,683, filed on Jun. 11, 2015.

(51) Int. Cl.
*B65D 71/36* (2006.01)
*B65D 5/48* (2006.01)
(Continued)

(52) U.S. Cl.
CPC ..... *B65D 5/48014* (2013.01); *B65D 5/106* (2013.01); *B65D 5/4204* (2013.01);
(Continued)

(58) Field of Classification Search
CPC .. B65D 5/48014; B65D 5/106; B65D 5/4204; B65D 5/443; B65D 71/36;
(Continued)

(56) References Cited

U.S. PATENT DOCUMENTS 1,896,326 A 2/1933 Northway-Ley
1,896,646 A 2/1933 Taylor
(Continued)

FOREIGN PATENT DOCUMENTS

CH 263456 8/1949
DE 88 14 144.6 1/1989
(Continued)

OTHER PUBLICATIONS

US 7,909,163, 03/2011, Harrelson (withdrawn)
International Search Report and Written Opinion for PCT/US2016/036599 dated Oct. 18, 2016.

*Primary Examiner* — King M Chu
(74) *Attorney, Agent, or Firm* — Womble Bond Dickinson (US) LLP

(57) ABSTRACT

A carton for holding at least one article. The carton includes an outer portion having a plurality of panels extending at least partially around an interior of the carton. The plurality of panels include a front panel, a back panel, a first side panel and a second side panel. A reinforcement portion is attached to the outer portion. The reinforcement portion comprises an attached portion in face-to-face contact with at least one panel of the plurality of panels and an unattached portion. The unattached portion comprises a divider extending between at least two panels of the plurality of panels and dividing the interior into a first compartment and a second compartment.

38 Claims, 10 Drawing Sheets

(51) Int. Cl.
*B65D 5/10* (2006.01)
*B65D 5/44* (2006.01)
*B65D 5/42* (2006.01)

(52) U.S. Cl.
CPC ..... *B65D 5/443* (2013.01); *B65D 71/36* (2013.01); *B65D 2571/0037* (2013.01); *B65D 2571/0066* (2013.01); *B65D 2571/00839* (2013.01)

(58) Field of Classification Search
CPC .... B65D 2571/0037; B65D 2571/0066; B65D 2571/00839
USPC ..... 206/427
See application file for complete search history.

(56) References Cited

U.S. PATENT DOCUMENTS

| | | | | |
|---|---|---|---|---|
| 2,299,027 | A | | 10/1942 | Novak |
| 2,875,952 | A | | 3/1959 | Wilson |
| 3,056,665 | A | | 10/1962 | Linda et al. |
| 3,101,880 | A | | 8/1963 | Peterson |
| 3,158,312 | A | | 11/1964 | Simkins |
| 3,166,232 | A | | 1/1965 | Tichenor |
| 3,822,785 | A | | 7/1974 | Getz et al. |
| 3,937,326 | A | | 2/1976 | Schick |
| 4,105,154 | A | | 8/1978 | Meyers et al. |
| 4,120,443 | A | | 10/1978 | Gardner et al. |
| 4,213,559 | A | | 7/1980 | Meyers |
| 4,421,229 | A | | 12/1983 | Pan et al. |
| 4,577,799 | A | | 3/1986 | Oliff |
| 4,605,158 | A | | 8/1986 | Barton |
| 4,919,269 | A | | 4/1990 | Wright |
| 5,143,278 | A | | 9/1992 | Petriekis et al. |
| 5,234,102 | A | | 8/1993 | Schuster et al. |
| 5,246,113 | A | | 9/1993 | Schuster |
| 5,316,210 | A | * | 5/1994 | Scullin ..... B65D 5/48048 229/117.16 |
| 5,415,344 | A | | 5/1995 | Harrelson |
| 5,427,242 | A | | 6/1995 | Oliff et al. |
| 5,437,143 | A | | 8/1995 | Culpepper et al. |
| 5,518,111 | A | | 5/1996 | Stout |
| 5,620,094 | A | | 4/1997 | Naumann |
| 5,669,500 | A | | 9/1997 | Sutherland |
| 5,682,984 | A | | 11/1997 | Howell et al. |
| 5,699,957 | A | | 12/1997 | Blin et al. |
| 5,772,030 | A | | 6/1998 | Baxter |
| 5,826,783 | A | | 10/1998 | Stout |
| 5,826,870 | A | | 10/1998 | Vulgamore et al. |
| 5,848,686 | A | | 12/1998 | Dean |
| 5,868,252 | A | | 2/1999 | Oliff |
| 5,938,109 | A | | 8/1999 | Sainz et al. |
| 5,957,288 | A | | 9/1999 | Campbell |
| 5,967,406 | A | | 10/1999 | Moorman |
| 5,996,883 | A | | 12/1999 | Bates |
| 6,012,630 | A | | 1/2000 | Block |
| 6,112,977 | A | | 9/2000 | Sutherland et al. |
| 6,176,419 | B1 | | 1/2001 | Holley, Jr. |
| 6,244,502 | B1 | | 6/2001 | Hollar et al. |
| 6,311,891 | B1 | | 11/2001 | Gardner |
| 6,386,369 | B2 | | 5/2002 | Yuhas et al. |
| 6,918,487 | B2 | | 7/2005 | Harrelson |
| 6,991,107 | B2 | | 1/2006 | Harrelson |
| 7,093,713 | B2 | | 8/2006 | Sutherland |
| 7,168,558 | B2 | | 1/2007 | Harrelson |
| 7,195,118 | B2 | | 3/2007 | Sutherland |
| 7,475,778 | B2 | | 1/2009 | Sutherland |
| 7,717,321 | B2 | | 5/2010 | Spivey, Sr. et al. |
| 8,459,535 | B2 | | 6/2013 | Brand |
| 8,720,743 | B2 | | 5/2014 | Smalley et al. |
| 8,800,853 | B2 | | 8/2014 | Brand |
| 9,132,936 | B2 | | 9/2015 | Kohler |
| 9,284,090 | B2 | | 3/2016 | Lettre et al. |
| 9,452,874 | B2 | | 9/2016 | Harrelson |
| 2004/0245327 | A1 | | 12/2004 | Oliff et al. |
| 2010/0122999 | A1 | | 5/2010 | Brand |
| 2014/0367380 | A1 | | 12/2014 | Stewart |

FOREIGN PATENT DOCUMENTS

| | | | |
|---|---|---|---|
| DE | 91 11 941.3 | | 2/1992 |
| EP | 0 595 602 | | 5/1994 |
| EP | 694 011 | B1 | 12/1999 |
| EP | 715 592 | B1 | 1/2000 |
| EP | 1 682 418 | B1 | 7/2011 |
| EP | 1 855 958 | B1 | 12/2015 |
| EP | 1 926 667 | B1 | 5/2016 |
| FR | 1427897 | | 4/1966 |
| FR | 1489087 | | 7/1967 |
| FR | 1497652 | | 10/1967 |
| FR | 2223985 | | 10/1974 |
| GB | 434145 | | 8/1935 |
| GB | 2 198 709 | | 6/1988 |
| GB | 2 323 352 | | 9/1998 |
| JP | 62-062617 | A | 10/1985 |
| JP | 62-130024 | | 8/1987 |
| JP | 1-73121 | | 5/1989 |
| JP | 7 125745 | | 5/1995 |
| JP | 9 142449 | | 6/1997 |
| JP | 11-130049 | | 5/1999 |
| JP | 2000-85754 | | 3/2000 |
| JP | 2002-526346 | A | 8/2002 |
| WO | WO 92/07772 | | 5/1992 |
| WO | WO 96/29261 | | 9/1996 |
| WO | WO 00/20288 | | 4/2000 |
| WO | WO 01/30659 | A1 | 5/2001 |
| WO | WO 02/030764 | | 4/2002 |
| WO | WO 2004/014755 | | 2/2004 |
| WO | WO 2012/115727 | A1 | 8/2012 |

* cited by examiner

CARTON WITH DIVIDER

CROSS REFERENCE TO RELATED APPLICATION

This application claims the benefit of U.S. Provisional Patent Application No. 62/230,683 filed Jun. 11, 2015.

INCORPORATION BY REFERENCE

The disclosure of U.S. Provisional Patent Application No. 62/230,683, which was filed Jun. 11, 2015, is hereby incorporated by reference for all purposes as if presented herein in its entirety.

BACKGROUND OF THE DISCLOSURE

The present disclosure generally relates to cartons for holding articles such as light bulbs, food or beverage products, or other types of articles. More specifically, the present disclosure relates to cartons having a divider.

SUMMARY OF THE DISCLOSURE

In general, one aspect of the disclosure is directed to a carton for holding at least one article. The carton comprising an outer portion comprising a plurality of panels extending at least partially around an interior of the carton. The plurality of panels comprising a front panel, a back panel, a first side panel and a second side panel. A reinforcement portion is attached to the outer portion. The reinforcement portion comprises an attached portion in face-to-face contact with at least one panel of the plurality of panels and an unattached portion. The unattached portion comprises a divider extending between at least two panels of the plurality of panels and dividing the interior into a first compartment and a second compartment.

In another aspect, the disclosure is generally directed to a blank for forming a carton for holding at least one article. The blank comprising an outer blank comprising a plurality of panels comprising a front panel, a back panel, a first side panel and a second side panel. A reinforcement blank is attached to the outer blank. The reinforcement blank comprises an attached portion in face-to-face contact with at least one panel of the plurality of panels and an unattached portion. The unattached portion comprises a divider for extending between at least two panels of the plurality of panels and dividing the interior of the carton formed from the blank into a first compartment and a second compartment.

In another aspect, the disclosure is generally directed to a method of forming a carton for holding at least one article. The method comprising obtaining an outer blank comprising a plurality of panels comprising a front panel, a back panel, a first side panel and a second side panel. The method comprises obtaining a reinforcement blank and attaching an attachment portion of the reinforcement blank in face-to-face contact with at least one panel of the plurality of panels. The method comprises fanning an unattached portion of the reinforcement blank, positioning the plurality of panels to form an interior of the carton, and forming a divider from the unattached portion that extends between at least two panels of the plurality of panels. The divider divides the interior of the carton into a first compartment and second compartment.

Those skilled in the art will appreciate the above stated advantages and other advantages and benefits of various additional embodiments from reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as packaged food products, consumer products, beverage containers, bottles, cans, etc. The articles can be used for packaging light bulbs, for example. The articles can be made from materials suitable in composition for packaging the particular food or consumer item. Cartons according to the present disclosure can accommodate articles of any shape. In this specification, the terms "inner," "interior," "outer," "exterior," "lower," "bottom," "upper," "top," "front," and "back" indicate orientations determined in relation to fully erected and upright cartons.

Figure 1:
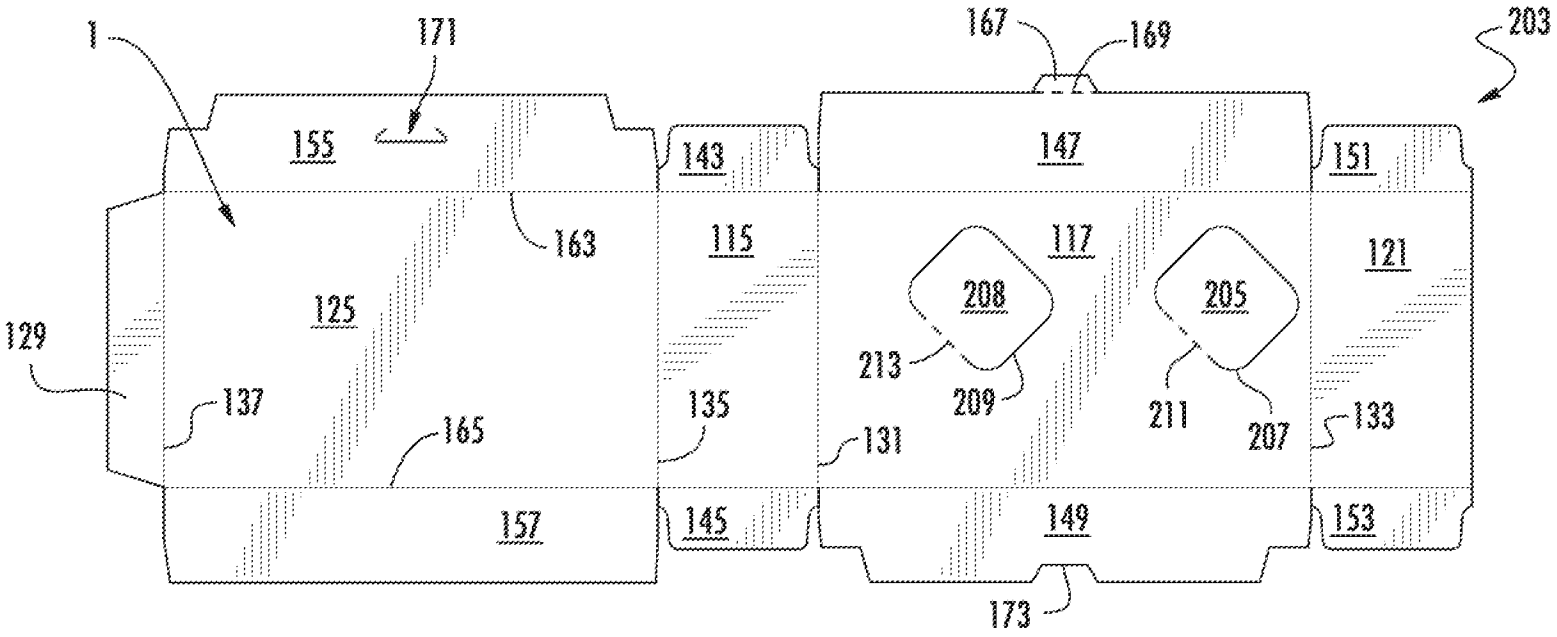
FIG. 1 is a plan view of an exterior surface of a blank according to an embodiment of the present disclosure.
Figure 2:
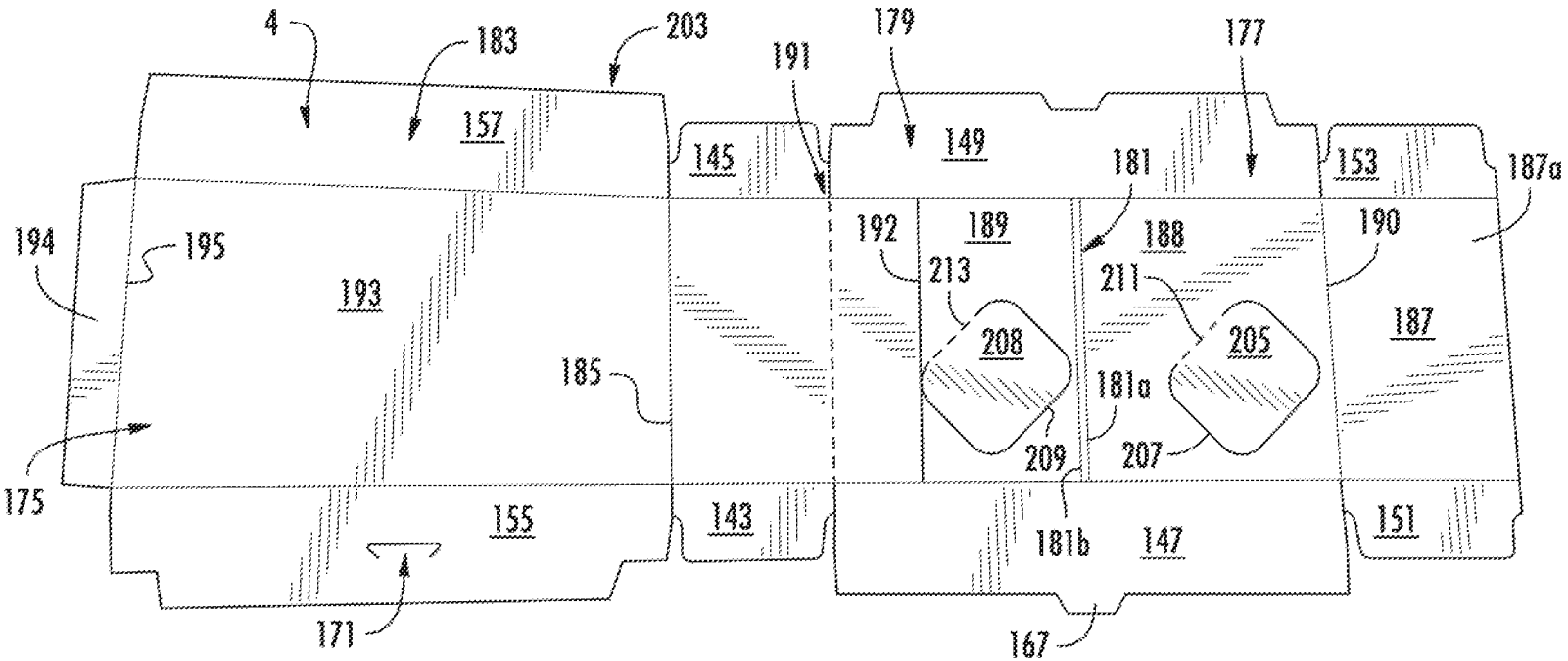
FIG. 2 is a top view of the interior surface of a blank according to an embodiment of the present disclosure.

FIG. 1 is a plan view of the exterior side 1 of a reinforced or laminated blank 203 that comprises a carton blank or outer blank, generally indicated at 103, and a reinforcement blank or divider blank 175 attached to the carton blank. FIG. 2 shows an interior side 4 of the reinforced blank 203. The reinforced blank 203 is formed into a carton 105 (FIGS. 6A-7B) according to the exemplary embodiment of the disclosure. The carton 105 can be used to house and protect a plurality of articles for display and transportation to the point of sale. The outer blank 103 forms an outer layer or portion of the carton 105 and the reinforcement blank 174 forms an inner layer or reinforcement portion of the carton.

It is understood that the carton 105 may be sized and shaped to hold articles of any desired quantity in a single layer or multiple layers without departing from the disclosure. In one embodiment, the outer portion 103 of the carton 105 comprises paperboard and the reinforcement portion 174 of the carton comprises paperboard. In the illustrated embodiment, the carton 105 includes openings 111 (FIGS. 6B, 6C, and 6B) for allowing visual inspection of the articles inside the carton, and the carton includes a divider 113 formed from the divider blank 175 that separates the articles. In one embodiment, the divider 113 divides an interior 216 of the carton 105 into a first compartment 214 and a second compartment 215. The divider blank 175 also is in face-to-face contact with portions of the carton blank 103 to reinforce the carton 105 formed from the reinforced blank 203. The reinforced blank 203 could have other features and could be otherwise formed without departing from the disclosure.

The carton blank 103 has a longitudinal axis L1 and a lateral axis L2. In the illustrated embodiment, the blank 103 comprises a first side panel 115, a front panel 117, a second side panel 121, a back panel 125, and an attachment flap 129. The first side panel 115 is foldably connected to the front panel 117 at a first lateral fold line 131. The front panel 117 is foldably connected to the second side panel 121 at a second lateral fold line 133. The first side panel 115 is foldably connected to the back panel 125 at a third lateral fold line 135. The back panel 125 is foldably connected to the attachment flap 129 at a fourth lateral fold line 137. Any of the panels 115, 117, 121, 125 can be otherwise shaped, arranged, configured, or omitted, without departing from the disclosure.

Figure 7A:
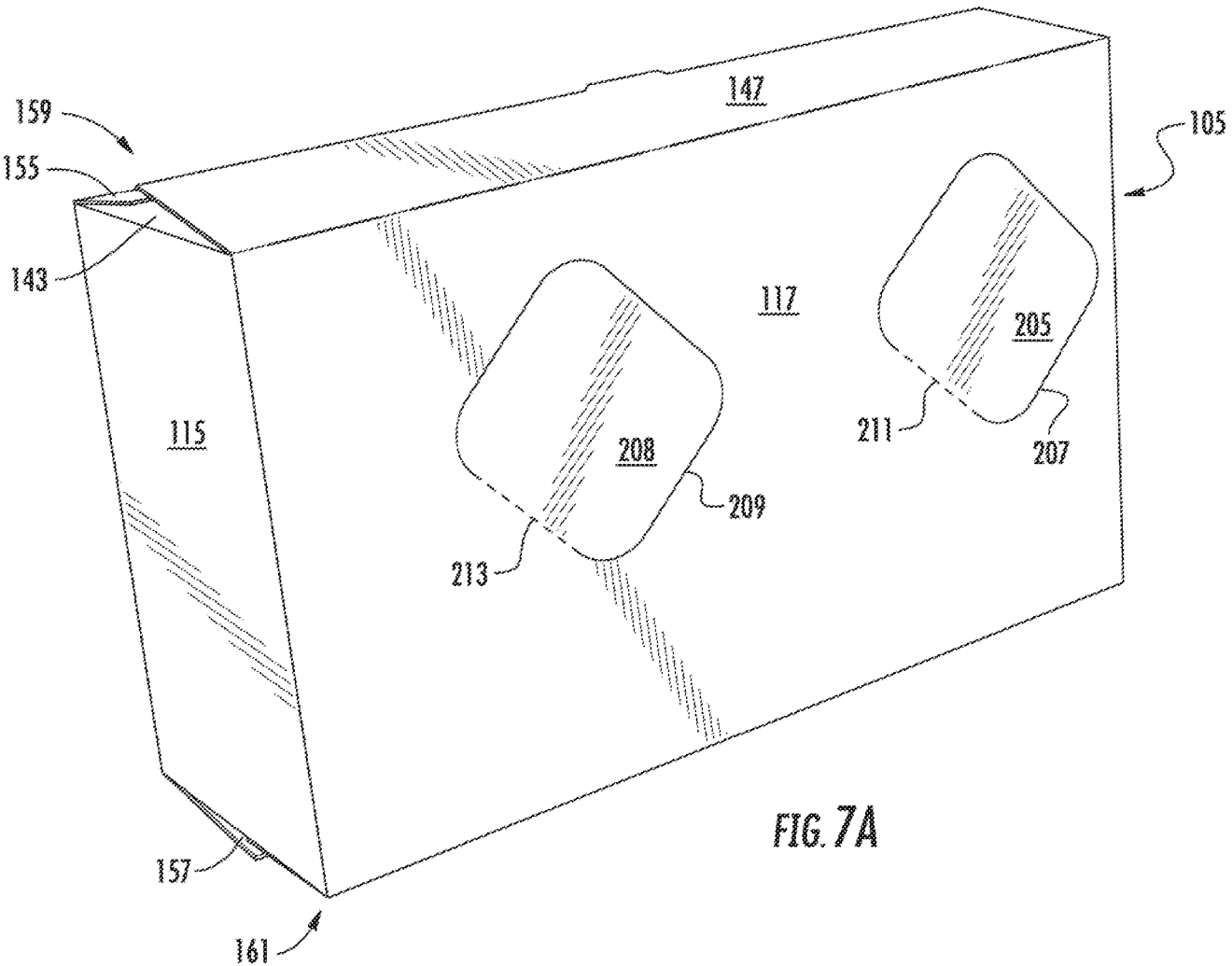
FIG. 7A is an exterior perspective view of a fully erected carton according to an embodiment of the present disclosure.
Figure 7B:
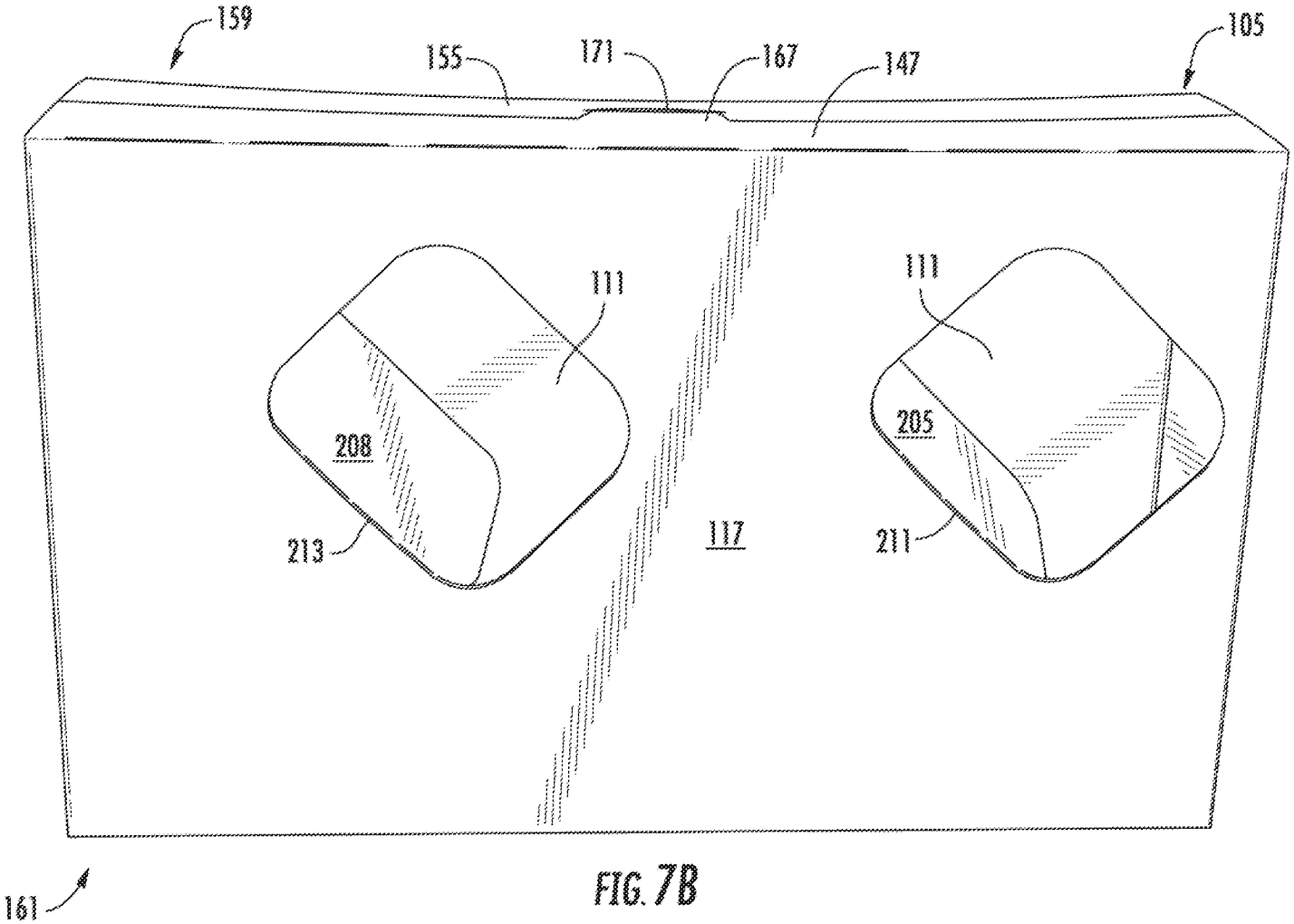
FIG. 7B is a side view of a fully erected carton with flaps folded inward according to an embodiment of the present disclosure.

The first end panel 115 is foldably connected to a top end flap 143 and a bottom end flap 145. The front panel 117 is foldably connected to a top end flap 147 and a bottom end flap 149. The second end panel 121 is foldably connected to a top end flap 151 and a bottom end flap 153. The second side panel 125 is foldably connected to a top end flap 155 and a bottom end flap 157. When the carton 105 is erected, the top end flaps 143, 147, 151, 155 close a top end 159 of the carton, and the bottom end flaps 145, 149, 153, 157 close a bottom end 161 of the carton (FIGS. 7A and 7B). In accordance with an alternative embodiment of the present disclosure, different flap arrangements can be used for at least partially closing the ends 159, 161 of the carton 105.

In one embodiment, the top end flaps 143, 147, 151, 155 extend along a first marginal area of the blank 103, and are foldably connected at a first longitudinal fold line 163 that extends along the length of the blank. In the illustrated embodiment, the bottom end flaps 145, 149, 153, 157 extend along a second marginal area of the blank 103, and are foldably connected at a second longitudinal fold line 165 that also extends along the length of the blank. The longitudinal fold lines 163, 165 may be, for example, substantially straight, or offset at one or more locations to account for blank thickness or for other factors.

In one embodiment, the carton 105 comprises locking features in the top end flaps 147, 155. The locking features include a male portion or tab 167 foldably connected to the top end flap 147 at longitudinal fold line 169 and a female portion 171 configured to accept male locking features and to hold the carton 105 in the closed configuration when the carton 105 is formed from the blank 103. The bottom end flap 149 can include a notch 173. The locking features 167, 169, 171 and notch 173 could be otherwise shaped, arranged, configured, and/or omitted without departing from the disclosure.

As shown in FIG. 2, the reinforcement blank 175 is attached to the carton blank 103 to form the reinforced blank 203. In the illustrated embodiment, the reinforcement blank 175 is generally rectangular and has a width slightly less than the width of panels 115, 117, 121, 125 of the blank 103. The reinforcement blank 175 provides increased structural and stacking strength to the carton 105 so that multiple cartons may be stacked on top of each other while protecting the articles inside of each carton. The reinforcement blank 175 can be adhesively attached (e.g., laminated) to the blank 103 by an adhesive, such as glue. The reinforcement blank 175 can have tear lines, fold lines, and other features to facilitate formation of the carton 105 from the blank 103 and the reinforcement blank 175 combination. The reinforcement blank 175 could be otherwise shaped, arranged, configured, and/or omitted without departing from the disclosure.

As illustrated in FIG. 2, the reinforcement blank 175 comprises a first section 177 foldably connected to a second section 179 at a fifth lateral fold line 181 and a third section 183 foldably connected to the second section 179 at a sixth lateral fold line 185. The first section 177 comprises a first panel 187 foldably connected to a second panel 188 at a seventh lateral fold line 190. The second section 179 comprises a third panel 189 foldably connected to a fourth panel 191 at an eighth lateral fold line 192. The third section 183 comprises a fifth panel 193 foldably connected to a sixth panel 194 at a ninth lateral fold line 195. The second panel 188 is foldably connected to the third panel 189 along the fold line 181 and the fourth panel 191 is foldably connected to the fifth panel 193 along fold line 185. In one embodiment, the fold line 181 may comprise two fold lines 181*a*, 181*b* wherein the fold line 181*a* is a crease line and the fold line 181*b* is a crease and cut line.

In one embodiment, the first panel 187 is adhesively attached to the second side panel 121 of the outer blank 103, the second panel 188 is adhesively attached to a portion of the front panel 117, the fifth panel 193 adhesively attached to the back panel 125, and the sixth panel 194 is adhesively attached to the attachment flap 129. The fourth panel 191 is free from attachment to the outer blank 103 and is adhesively attached to the fifth panel 193 and in face-to-face contact with the fifth panel. As illustrated in FIG. 1, the fold lines 133, 135, 137 of blank 103 are generally aligned with the fold lines 190, 185, 195 of the reinforcement blank 175 and the first and third portions 177, 183 of blank 175 are adhered or laminated to respective portions of panels 121, 117, 125, 129 of blank 103 and form an attached portion of the reinforcement blank 175 that is attached to the outer blank 103. In one embodiment, the second portion 179 of the reinforcement blank 175, including panels 189, 191, are free from adhesive attachment to the blank 103 and form an unattached portion that is free from attachment to the outer blank 103. As such, the panels 189, 191 are free to move and be positioned relative to the blank 103 when the carton 105 is formed from the reinforced blank 203.

Figure 3:
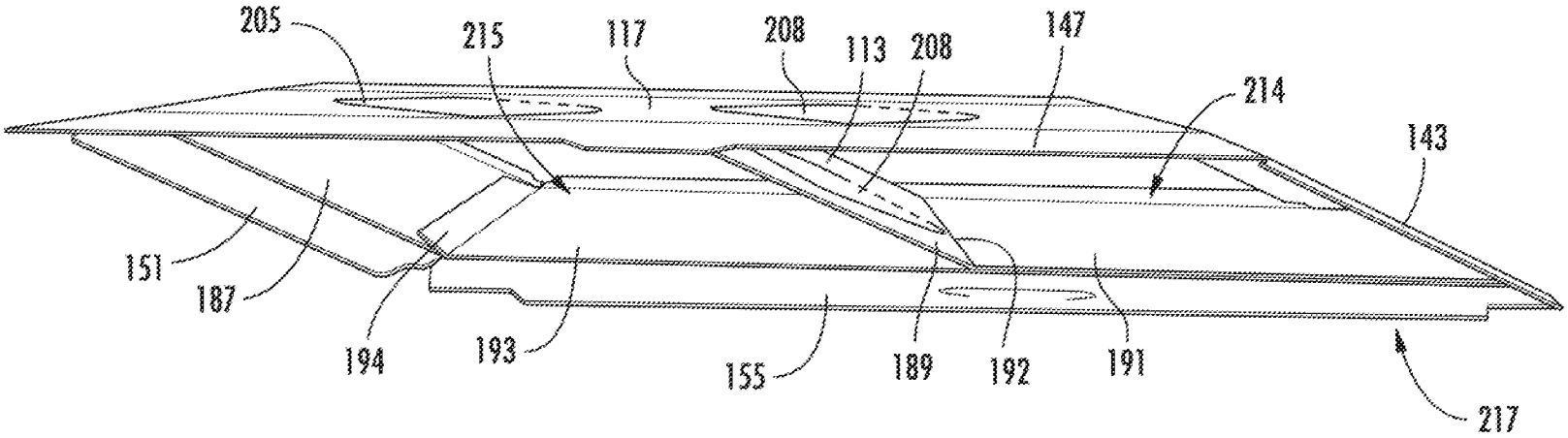
FIG. 3 is a side view of a sleeve formed from a blank according to an embodiment of the present disclosure.

As shown in FIGS. 1 and 3, the outer blank 103 and reinforcement blank 175 may be laminated together to form the reinforced blank 203. The reinforced blank 203 may comprise a first flap 205 defined by a cut line 207 and foldably connected to the panels 117, 188 along a first oblique fold line 211 and a second flap 208 defined by a cut line 209 and foldably connected to the panels 117, 189 along a second oblique fold line 213. Discussed in more detail below, when the carton 105 is fanned from the reinforced blank 203, the third panel 189 in the second section 179 of the reinforcement blank 175 extends between the panels 117, 125 of the carton blank 103 to form the divider 113, separating the interior 216 of the carton 105 into a first compartment 214 and a second compartment 215. The flaps 205, 208 can be positioned in the respective compartments 215, 214, partially dividing the compartments and also forming openings 111 for viewing the contents inside the carton 105. The flaps 205, 208 and openings 111 could be otherwise shaped, arranged, and/or configured without departing from the disclosure.

In one exemplary embodiment, the carton 105 can be assembled by using lamination methods and techniques used to produce Z-FLUTE laminated folding cartons available from Graphic Packaging International, Inc. in Atlanta, Ga. Such laminations methods and techniques may be disclosed in U.S. Pat. Nos. 7,201,714; 8,317,671; 8,403,819; 8,403,820; and U.S. Patent Application Publication No. 2013/0029823, the disclosures of which are all incorporated by reference herein for all purposes.

In one embodiment, the reinforced blank 203 is formed by laminating the reinforcement blank 175 and the outer blank 103, such that the reinforcement blank is selectively attached to portions of the outer blank. After obtaining the reinforced blank 203 as shown in FIGS. 1-2, the reinforced blank is formed into the carton 105 by folding the panels 121, 125 about respective fold lines 133, 135. The adhesive flap 129 is positioned in face-to-face contact with the first panel 187 and is secured to the edge portion 187*a* of the first panel 187 of the divider blank 175. Prior to or after securing the adhesive flap 129, adhesive may be placed on or between the fourth and fifth panels 191, 193 of the reinforcement blank to secure the exterior of fourth and fifth panels 191, 193 together.

Figure 4:
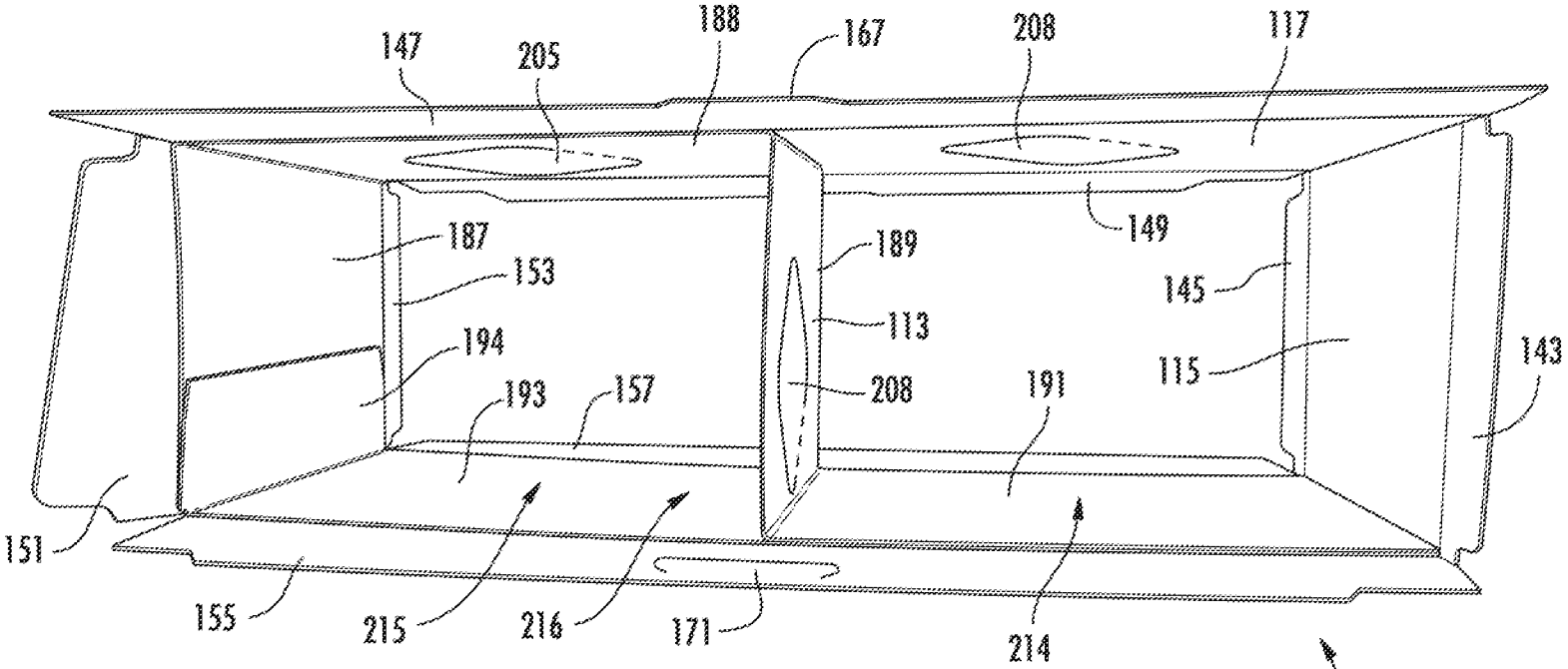
FIG. 4 is a side view of sleeve formed from a blank according to an embodiment of the present disclosure.
Figure 5:
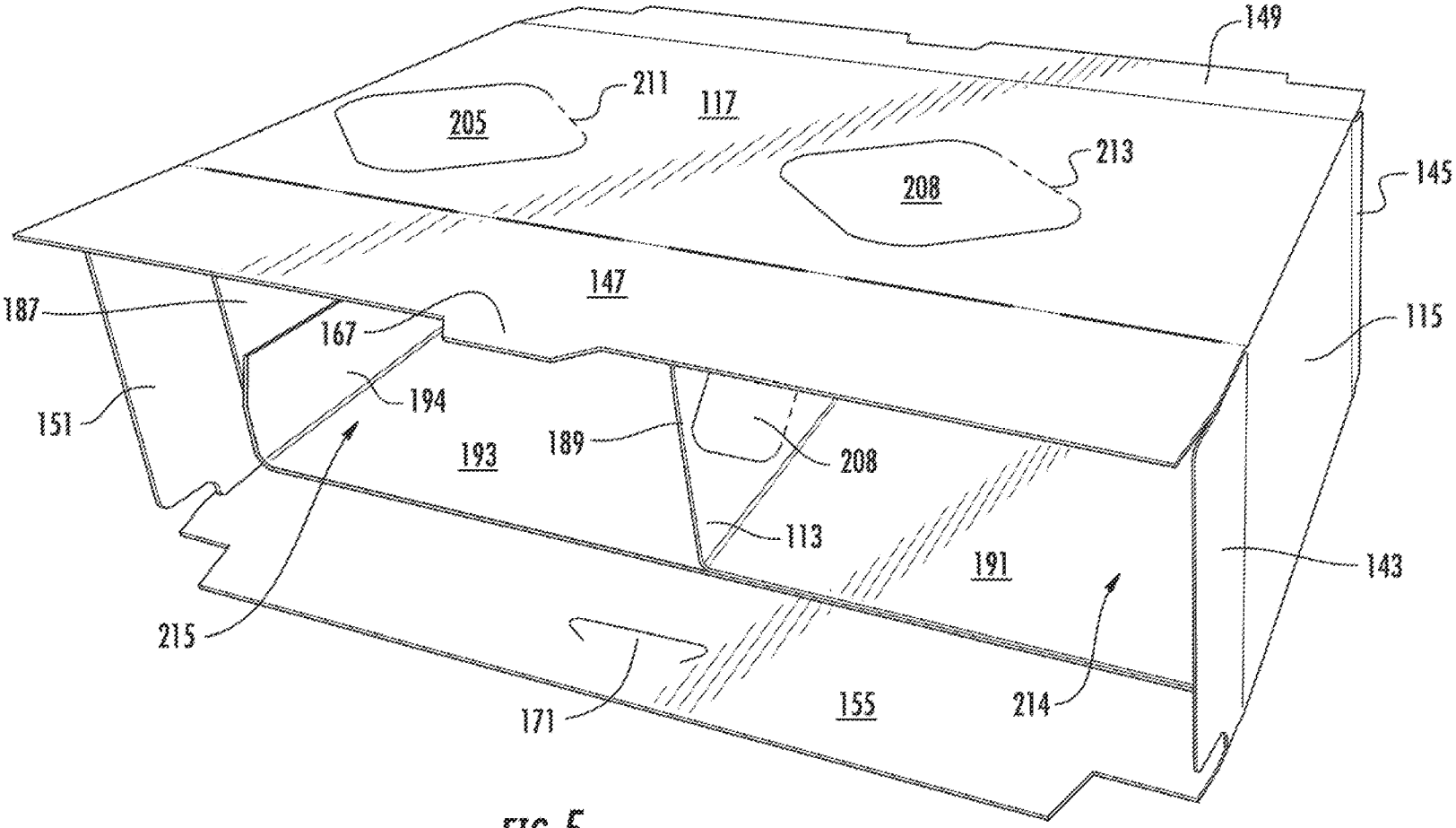
FIG. 5 is an exterior perspective view of a sleeve formed from a blank according to an embodiment of the present disclosure.
Figure 6A:
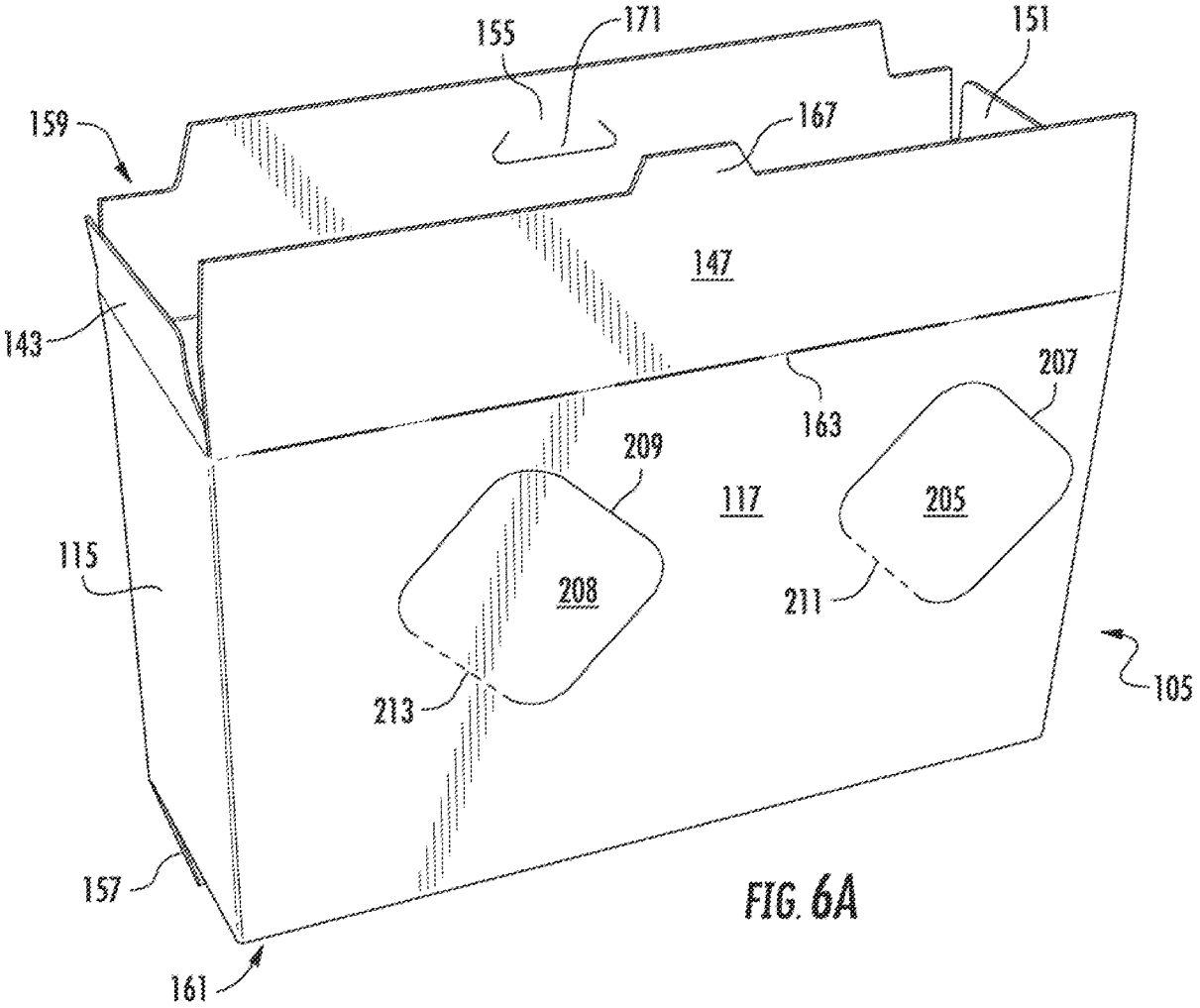
FIG. 6A is an exterior perspective view of a carton having an open top end according to an embodiment of the present disclosure.
Figure 6B:
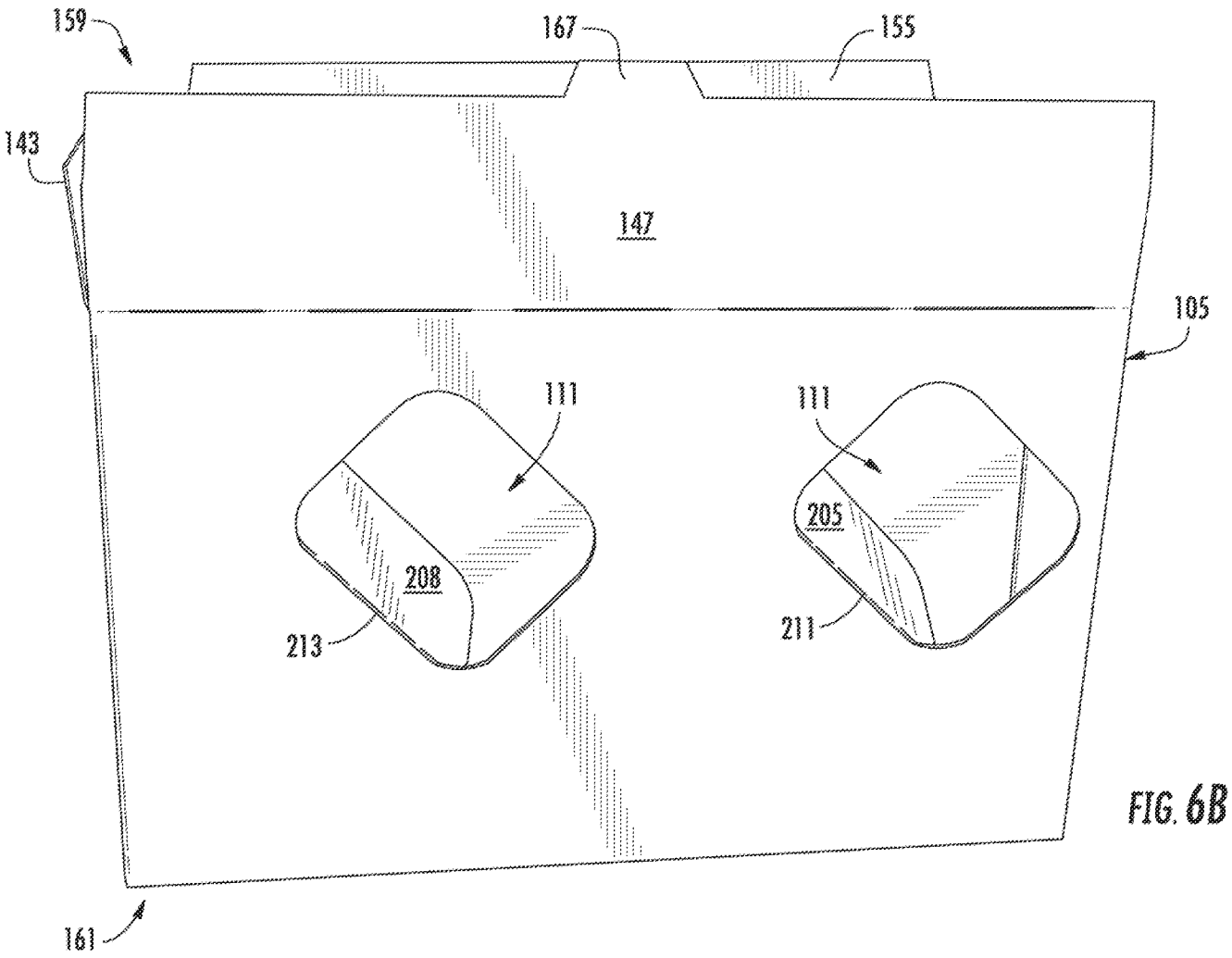
FIG. 6B is an exterior perspective view of a carton having an open top end and flaps folded inward according to an embodiment of the present disclosure.
Figure 6C:
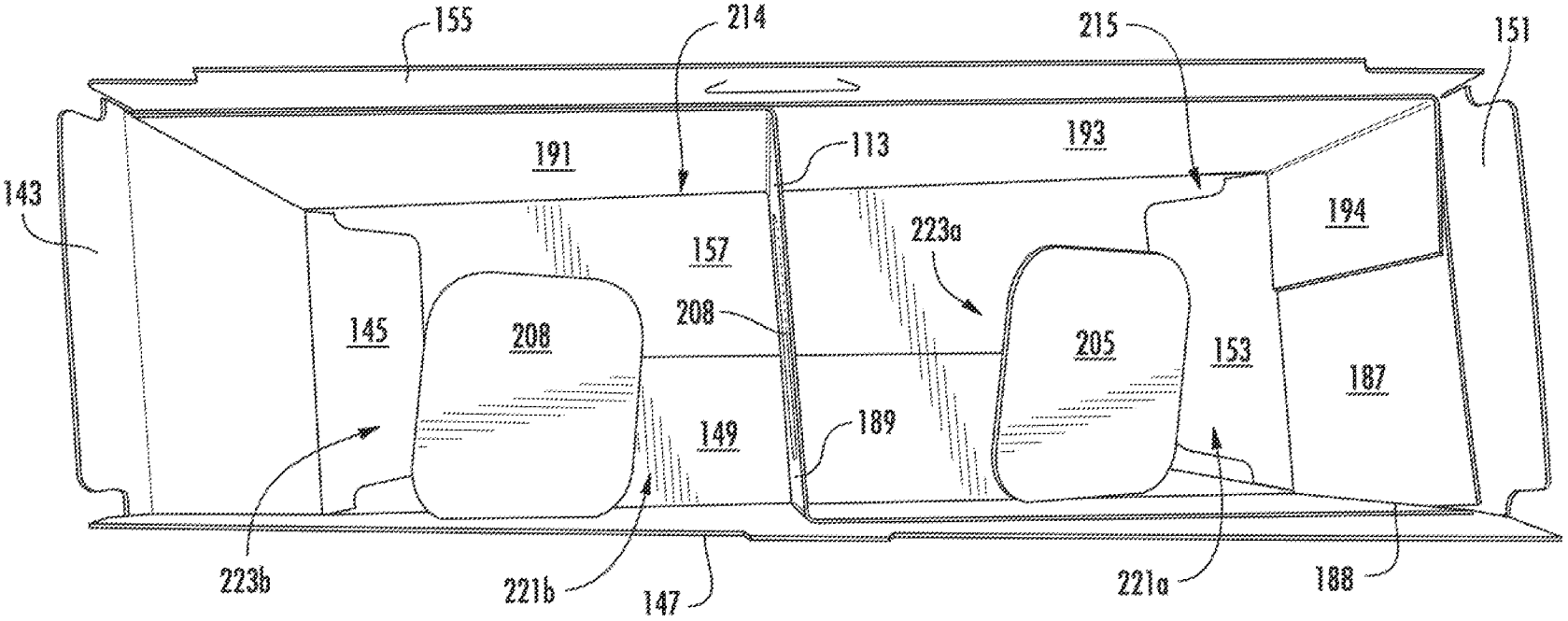
FIG. 6C is an interior perspective view of a carton with having an open top end and flaps folded inward according to an embodiment of the present disclosure.

As shown in FIGS. 3 and 4, the blank 203 is further assembled into a sleeve 217 by positioning the first side panel 115 and second side panel 121 to be in a generally spaced-apart, parallel planar relationship and positioning the front panel 117 and back panel 125 to be in a generally spaced-apart, parallel planar relationship. Such movement of the side panels 115, 121 and front and back panels 117, 125, causes the third panel 189 (i.e., divider flap 113) to rotate about fold lines 181 (i.e., 181*a*, 181*b*) and 192 and be positioned generally perpendicular to the front and back panels 117, 125. Accordingly, the interior of the sleeve is divided into two article receiving spaces 214, 215 by the divider flap 113. Flaps 205, 208 can be folded inward along fold lines 211, 213 and positioned to divide article receiving spaces 214, 215 into an upper portion (i.e., first portion) 221*a*, 221*b* and lower portion (i.e., second portion) 223*a*, 223*b* (FIG. 6C). The sleeve 217 can be loaded with articles in the interior, or the articles could be loaded before or after closing either or both of the ends 159, 161 of the carton 105. The sleeve 217 could be otherwise formed without departing from the scope of this disclosure.

In one embodiment, the ends 159, 161 of the carton 105 can be closed by folding the top end flaps 143, 151 downwardly and then overlapping the top end flaps 147, 155 to close the top 159 of the carton. The top end flaps 147, 155 are sized to at least partially overlap so that the end flaps 147, 155 can be secured together in an overlapped relationship by adhesive such as glue. Further, the top end flaps 147, 155 can be secured to one or both of the top end flaps 143, 151 without departing from the disclosure. In the illustrated embodiment, the second end 161 can be closed in a similar or identical manner as the first end 159. The first end 159 and/or the second end 161 could be closed by other steps without departing from the disclosure.

The cartons of any of the illustrated or non-illustrated embodiments of the disclosure could have other or additional features (e.g., dispenser features, handle features, reinforcement features, etc.) without departing from the disclosure. Also, the cartons could be otherwise shaped, arranged, or configured and the cartons could be configured to hold articles of various shapes and sizes without departing from the disclosure.

The blanks according to the present disclosure can be, for example, foamed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

an outer portion comprising a plurality of panels extending at least partially around an interior of the carton, the plurality of panels comprising a front panel, a back panel, a first side panel and a second side panel; and a reinforcement portion attached to the outer portion, the reinforcement portion comprises an attached portion in face-to-face contact with at least one, of the front panel and the back panel and the reinforcement portion comprises an unattached portion, the unattached portion comprises a divider extending between at least two panels of the plurality of panels and dividing the interior into a first compartment and a second compartment.

2. The carton of claim 1, wherein the outer portion comprises an outer layer of paperboard and the reinforcement portion comprises an inner layer of paperboard.

3. The carton of claim 2, wherein the plurality of panels is a first plurality of panels and the reinforcement portion comprises a second plurality of panels comprising a first panel, a second panel foldably connected to the first panel, a third panel foldably connected to the second panel, a fourth panel foldably connected to the third panel, and a fifth panel foldably connected to the fourth panel.

4. The carton of claim 3, wherein the first panel is adhesively attached to the second side panel and the second panel is adhesively attached to a portion of the front panel.

5. The carton of claim 4, wherein the fifth panel is adhesively attached to the back panel.

6. The carton of claim 5, wherein the third panel is free from adhesive attachment to the outer portion.

7. The carton of claim 6, wherein the fourth panel is free from adhesive attachment to the outer portion.

8. The carton of claim 7, wherein the third panel comprises the divider that extends between the front panel and the back panel.

9. The carton of claim 8, wherein the fourth panel is adhesively attached to the fifth panel and in face-to-face contact with the fifth panel.

10. The carton of claim 8, wherein the first side panel is free from contact with the reinforcement portion.

11. The carton of claim 1, comprising at least two flaps in at least one of the panels, each of the flaps being foldably connected to the at least one panel to form a respective inspection opening when the flaps are folded with respect to the at least one panel.

12. The carton of claim 11, wherein the at least two flaps are foldably connected to the front panel, at least one of the two flaps comprises a portion of the reinforcement portion.

13. The carton of claim 12, wherein the at least two flaps comprises a first flap and a second flap, the first flap being positionable into the first compartment, the first flap being positionanble into the first compartment to divide the first compartment, and the second flap being positionable into the second compartment to divide the first compartment.

14. A carton for holding at least one article, the carton comprising:

an outer portion comprising a plurality of panels extending at least partially around an interior of the carton, the plurality of panels comprising a front panel, a back panel, a first side panel and a second side panel, the outer portion comprises a plurality of end flaps, each end flap of the plurality of end flaps is foldably connected to a respective panel of the plurality of panels; and a reinforcement portion attached to the outer portion, the reinforcement portion comprises an attached portion in face-to-face contact with at least one panel of the plurality of panels and an unattached portion, the unattached portion comprises a divider extending between at least two panels of the plurality of panels and dividing the interior into a first compartment and a second compartment, the plurality of end flaps is free from contact with the reinforcement portion.

15. A blank for forming a carton for holding at least one article, the blank comprising:

an outer blank comprising a plurality of panels comprising a front panel, a back panel, a first side panel and a second side panel; and a reinforcement blank attached to the outer blank, the reinforcement blank comprises an attached portion in face-to-face contact with at least one of the front panel and the back panel and the reinforcement blank comprises an unattached portion, the unattached portion comprises a divider for extending between at least two panels of the plurality of panels and dividing the interior of the carton formed from the blank into a first compartment and a second compartment.

16. The blank of claim 15, wherein the outer blank comprises an outer layer of paperboard and the reinforcement blank comprises an inner layer of paperboard.

17. The blank of claim 16, wherein the plurality of panels is a first plurality of panels and the reinforcement blank comprises a second plurality of panels comprising a first panel, a second panel foldably connected to the first panel, a third panel foldably connected to the second panel, a fourth panel foldably connected to the third panel, and a fifth panel foldably connected to the fourth panel.

18. The blank of claim 17, wherein the first panel is adhesively attached to the second side panel and the second panel is adhesively attached to a portion of the front panel.

19. The blank of claim 18, wherein the fifth panel is adhesively attached to the back panel.

20. The blank of claim 19, wherein the third panel is free from adhesive attachment to the outer blank.

21. The blank of claim 20, wherein the fourth panel is free from adhesive attachment to the outer blank.

22. The blank of claim 21, wherein the third panel comprises the divider that is for extending between the front panel and the back panel in the carton formed from the blank.

23. The blank of claim 22, wherein the fourth panel is adhesively attached to the fifth panel and in face-to-face contact with the fifth panel.

24. The blank of claim 15, comprising at least two flaps in at least one of the panels, each of the flaps being foldably connected to the at least one panel to form a respective inspection opening when the flaps are folded with respect to the at least one panel in the carton formed from the blank.

25. The blank of claim 24 wherein the at least two flaps are foldably connected to the front panel, at least one of the two flaps comprises a portion of the reinforcement blank.

26. The blank of claim 25, wherein the at least two flaps comprises a first flap and a second flap, the first flap being positionable into the first compartment, the first flap being positionable into the first compartment to divide the first compartment in the carton formed from the blank, and the second flap being positionable into the second compartment to divide the second compartment in the carton formed from the blank.

27. A blank for forming a carton for holding at least one article, the blank comprising:

an outer blank comprising a plurality of panels comprising a front panel, a back panel, a first side panel and a second side panel, the outer blank comprises a plurality of end flaps, each end flap of the plurality of end flaps is foldably connected to a respective panel of the plurality of panels; and a reinforcement blank attached to the outer blank, the reinforcement blank comprises an attached portion in face-to-face contact with at least one panel of the plurality of panels and an unattached portion, the unattached portion comprises a divider for extending between at least two panels of the plurality of panels and dividing the interior of the carton formed from the blank into a first compartment and a second compartment, the plurality of end flaps is free from contact with the reinforcement blank.

28. A method of forming a carton for holding at least one article, the method comprising:

obtaining an outer blank comprising a plurality of panels comprising a front panel, a back panel, a first side panel and a second side panel;

obtaining a reinforcement blank;

attaching an attachment portion of the reinforcement blank in face-to-face contact with at least one of the front panel and the back panel;

forming an unattached portion of the reinforcement blank;

positioning the plurality of panels to form an interior of the carton;

forming a divider from the unattached portion that extends between at least two panels of the plurality of panels, the divider divides the interior of the carton into a first compartment and second compartment.

29. The method of claim 28, wherein the outer blank forms an outer layer of paperboard of the carton and the reinforcement blank forms an inner layer of paperboard of the carton.

30. The method of claim 29, wherein the plurality of panels is a first plurality of panels and the reinforcement blank comprises a second plurality of panels comprising a first panel, a second panel foldably connected to the first panel, a third panel foldably connected to the second panel, a fourth panel foldably connected to the third panel, and a fifth panel foldably connected to the fourth panel, the method comprises adhesively attaching the first panel to the second side panel and adhesively attaching the second panel to a portion of the front panel.

31. The method of claim 30, further comprising adhesively attaching the fifth panel to the back panel.

32. The method of claim 31, wherein the third panel is free from adhesive attachment to the outer blank and the fourth panel is free from adhesive attachment to the outer blank.

33. The method of claim 32, wherein the forming the divider comprises positioning the third panel to extend between the front panel and the back panel.

34. The method of claim 33, further comprising adhesively attaching the fourth panel to the fifth panel and positioning the fourth panel in in face-to-face contact with the fifth panel.

35. The method of claim 33, wherein the first side panel is free from contact with the reinforcement blank.

36. The method of claim 28, wherein the outer blank comprises at least two flaps in at least one of the panels, each of the flaps being foldably connected to the at least one panel, the method comprising folding the at least two flaps with respect to the at least one panel to form a respective inspection opening.

37. The method of claim 36, wherein the at least two flaps are foldably connected to the front panel, at least one of the two flaps comprises a portion of the reinforcement blank, the at least two flaps comprises a first flap and a second flap, the folding the at least two flaps comprises positioning the first flap into the first compartment to divide the first compartment and positioning the second flap into the second compartment to divide the second compartment.

38. A method of forming a carton for holding at least one article, the method comprising:

obtaining an outer blank comprising a plurality of panels comprising a front panel, a back panel, a first side panel and a second side panel, the outer blank comprises a plurality of end flaps, each end flap of the plurality of end flaps is foldably connected to a respective panel of the plurality of panels;

obtaining a reinforcement blank;

attaching an attachment portion of the reinforcement blank in face-to-face contact with at least one panel of the plurality of panels, the plurality of end flaps are free from contact with the reinforcement blank;

forming an unattached portion of the reinforcement blank;

positioning the plurality of panels to form an interior of the carton;

forming a divider from the unattached portion that extends between at least two panels of the plurality of panels, the divider divides the interior of the carton into a first compartment and second compartment;

at least partially overlapping the plurality of end flaps to close an end of the carton.

* * * * *